US009033173B2

(12) United States Patent
Beyer et al.

(10) Patent No.: US 9,033,173 B2
(45) Date of Patent: May 19, 2015

(54) OVERPACK FOR STORAGE AND HANDLING FOR CONTAINERS FOR LIQUIDS

(75) Inventors: Sarah Beyer, Düsseldorf (DE); Roman Köppel, Baar (CH); Dirk Kullwitz, Tönisvorst (DE); Mohammed Ashraf, München (DE)

(73) Assignee: Ecolab USA Inc., St. Paul, MN (US)

( * ) Notice: Subject to any disclaimer, the term of this patent is extended or adjusted under 35 U.S.C. 154(b) by 0 days.

(21) Appl. No.: 13/809,485

(22) PCT Filed: Jul. 14, 2010

(86) PCT No.: PCT/EP2010/004296

§ 371 (c)(1),
(2), (4) Date: Jun. 5, 2013

(87) PCT Pub. No.: WO2012/007022

PCT Pub. Date: Jan. 19, 2012

(65) Prior Publication Data

US 2013/0240523 A1 Sep. 19, 2013

(51) Int. Cl.

| | |
|---|---|
| ***B65D 88/12*** | (2006.01) |
| ***B65D 77/04*** | (2006.01) |
| ***B65D 19/04*** | (2006.01) |

(52) U.S. Cl.

CPC ..... *B65D 88/129* (2013.01); *B65D 19/04* (2013.01); *B65D 77/0466* (2013.01); *B65D 2519/00034* (2013.01); *B65D 2519/00069* (2013.01); *B65D 2519/00174* (2013.01); *B65D 2519/00208* (2013.01); *B65D 2519/00268* (2013.01); *B65D 2519/00288* (2013.01); *B65D 2519/00318* (2013.01); *B65D 2519/00422* (2013.01); *B65D 2519/00497* (2013.01); *B65D 2519/00771* (2013.01); *B65D 2519/008* (2013.01); *B65D 2519/00805* (2013.01); *B65D 2519/00975* (2013.01)

(58) Field of Classification Search

CPC ..... B65D 77/0466; B65D 77/0453; B65D 77/0446; B65D 77/04; B65D 21/0215; B65D 21/0213; B65D 21/0212; B65D 21/0209; B65D 88/06; B65D 88/025

USPC ..... 220/23.91, 23.87, 23.86, 23.83, 23.89, 220/676, 661; 206/511, 509, 504

See application file for complete search history.

(56) References Cited

U.S. PATENT DOCUMENTS 3,964,636 A * 6/1976 Rehrig ..... 220/495.06
4,095,720 A 6/1978 Delbrouck et al.

(Continued)

FOREIGN PATENT DOCUMENTS

| | | | |
|---|---|---|---|
| DE | 3434174 | A1 | 3/1986 |
| EP | 0976662 | A1 | 2/2000 |
| WO | WO91/18806 | A1 | 12/1991 |

OTHER PUBLICATIONS

Translation of WO 91/18806 (Burgdorf et al.) Dec. 12, 1991, p. 5.*

*Primary Examiner* — Robert J Hicks
(74) *Attorney, Agent, or Firm* — Merchant & Gould P.C.

(57) ABSTRACT

The invention relates to an overpack 1 for storage and handling of containers for liquids, preferably for drums 2 with volumes of 200 to 500 liters, wherein the overpack 1 is integrally formed of plastics and stackable. The invention further relates to a safety system 9 for storage and handling of containers for liquids comprising an overpack 1 according to the invention and a container located inside the overpack 1.

19 Claims, 4 Drawing Sheets

(56) References Cited

Figure 1:
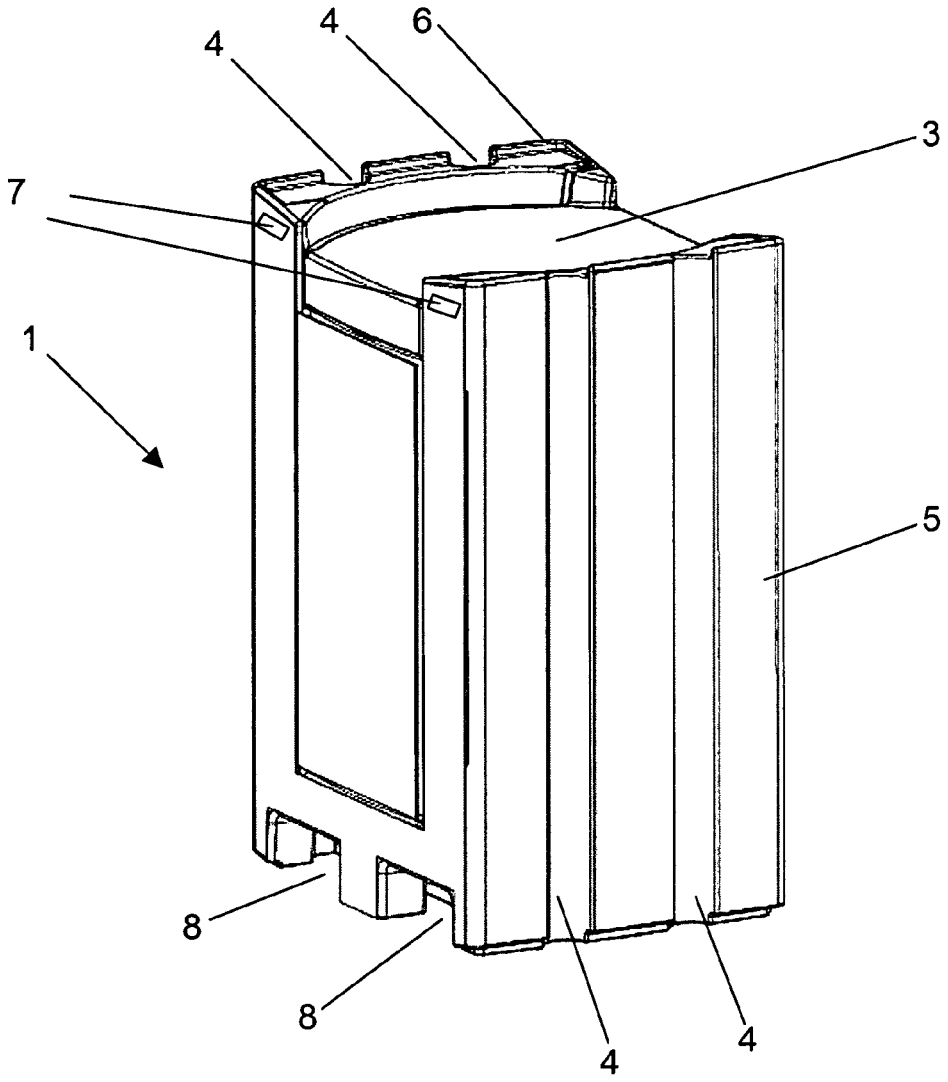

U.S. PATENT DOCUMENTS 5,201,432 A * 4/1993 Elvin-Jensen ..... 220/1.5
5,465,865 A 11/1995 Coombes
5,794,818 A * 8/1998 Bromwell et al. ..... 222/105
2006/0032854 A1* 2/2006 Schutz ..... 220/562
2011/0315689 A1* 12/2011 Meints et al. ..... 220/500
2012/0261063 A1* 10/2012 Schutz ..... 156/245

* cited by examiner

OVERPACK FOR STORAGE AND HANDLING FOR CONTAINERS FOR LIQUIDS

CROSS REFERENCE TO RELATED APPLICATION

This application is a National Stage Application of PCT/EP2010/004296 filed 14 Jul. 2010, the entire disclosure of which is incorporated herein by reference in its entirety.

The invention relates to an overpack for storage and handling of containers for liquids, preferably for drums with volumes of 200 to 500 liters.

The purpose of the present invention is to provide an overpack for containers for the containment of liquids, like detergents or chemicals, so that the containers can be handled, transported and stored safely around the world. Furthermore, the overpack provides a spill containment, to avoid the need of a space consuming separate drip tray. Such overpacks are for example used by manufacturers to supply the detergents or chemicals to customers.

Overpacks for the handling and storage of containers for liquids containing detergents or chemicals need to satisfy national and/or international safety standards to be approved. Such national and/or international safety standards are set for example by the German government or the European Organisation for Technical Approvals (EOTA). National technical approvals for Germany and/or european technical approvals will be granted for example by the "Deutsches Institut für Bautechnik (DIBt)".

An overpack which applied for a national technical approval at the DIBt is sold by the company Promens under the name "Drumtainer". The Drumtainer is an overpack, which has been developed for transportation, storage and handling of drums with volumes of 200 to 300 liters. The Drumtainer is integrally formed of plastic and has an integrated spill containment function. However, due to the curved lid, the Drumtainer is not stackable.

A further overpack is sold by Johnson Diversey under the name of "Safe Pack XL". The Safe Pack XL consists of at least two parts and is not stackable as the upper part of the contained drum projects out of the overpack.

WO 96/04659 A1 discloses an overpack for a drum containing radioactive material. Because of the higher safety standards for overpacks containing drums filled with radioactive materials the disclosed overpack is made of steel or other high strength material. Due to the higher safety standards and the used materials the disclosed overpack is expensive.

It is an object of the present invention to provide an overpack for storage and handling of containers for liquids, like detergents or chemicals, preferably for drums with volumes of 200 to 500 liters, which are easy to produce and can be handled, transported and stored efficiently.

According to the invention the object is solved by an overpack for storage and handling of containers for liquids, preferably for drums with volumes of 200 to 500 liters, wherein the overpack is integrally formed of plastics and wherein the overpack is stackable.

By stackable in the sense of the invention is meant, that the upper and lower portion of overpacks at least partially match each other in such a way, that at least two overpacks can be stored on top of each other without the risk, that an overpack drops down or that the lower overpack is damaged due to the load. Overpacks according to the invention have the advantage, that they can be put on top of each other during transportation, for example by truck, ship or train, or during storage in a depot. This reduces the required space for transportation and/or storage, which reduces the costs relating to the handling of the overpacks and the contained containers for liquids.

Advantageously the overpack comprises an opening to insert the container into the overpack or to remove it from the overpack. Hence, the container can be replaced in case of damage or be cleaned easier.

According to an embodiment of the invention the opening is covered by a lid, to prevent rain or dirt from entering the overpack. Preferably the lid is removably attached to the overpack. This has the advantage, that the lid is replaceable. According to a further embodiment the lid is arrangeable next to a side wall of the overpack in an open position to minimize the required space for an opened overpack. Furthermore, the handling for customers of the overpack is improved, as the lid is not standing upright, where it might be in the way of dosing equipment.

In a preferred embodiment of the invention the opening comprises recesses for a container handling system, like a drum lift. The advantage is, that the container can be easily inserted into or removed from the overpack with the help of a container handling system. The recesses can also be used to check if there is some leakage in the overpack or not, as required by the DIBT.

To prevent fluids like rain from entering the overpack in case the opening is closed by the lid the opening preferably comprises a rain drain.

According to a further embodiment of the invention at least one side wall of the overpack comprises at least one reinforcement rib, to increase the rigidity of the overpack. Preferably the at least one reinforcement rib is built vertically at a side wall of the overpack. This results in a higher rigidity of the overpack in a vertical direction, so that more overpacks can be stacked on top of each other without damaging the lower overpacks.

Advantageously the overpack is free of reinforcements made of a second material. This has the advantage that the overpack can be produced in a single process and no additional reinforcement elements have to be inserted into or mounted onto the overpack.

Preferably the overpack is formed without undercuts. This reduces the complexity of the production process of the overpack; hence the overpack can be produces easier.

According to a further embodiment of the invention the overpack further comprises at least one cleaning opening, preferably in a side wall, for emptying a cleaning fluid from the overpack. After cleaning an overpack the used cleaning fluid remains at least partially in the overpack due to the spill containment function of the overpack. The cleaning opening can be used to emptying the cleaning fluid from the overpack. Advantageously the cleaning opening is located in a side wall of the overpack, preferably in an upper portion of the side wall.

In a preferred embodiment of the invention the base area of the overpack is about 600 mm by 800 mm. Two overpacks with such dimensions can be put next to each other on a pallet which satisfies the regulations of the European Pallet Association.

To improve the handling of overpacks according to the invention the overpack comprises handling recesses, preferably for a fork lift and/or a hand lift. Preferably the handling recesses are formed from one side wall of the overpack to the opposing side wall of the overpack. This has the advantage, that the overpack can be lifted from both side walls by a fork lift or a hand lift. More preferably the two opposing side walls with the greatest dimension comprise the handling recesses. To further improve the handling of overpacks according to the invention by hand lifts, which have a limited elevation, the handling recesses are located at the base portion of the overpack.

According to a further embodiment of the invention the overpack does not comprise wheels for transportation. This has the advantage, that the overpack can be easier stored on a pallet, as no additional securing means are required. Furthermore, overpacks with wheels are not stackable unless the wheels are locked or moved to a transport position in which they do not contact the ground or underlying overpack.

The invention further relates to a safety system for storage and handling of containers for liquids comprising an overpack according to the invention and a container located inside the overpack.

According to a preferred embodiment of the safety system the container comprises a dry break system. A dry break system eases the connection of the container with a consumer of the liquid contained in the container. Preferably the size of the dry break system is different for different products inside the container. Different sizes of the dry break system assure that the consumer of the liquid is connected with the correct safety system containing the designated liquid.

In a further preferred embodiment the safety system comprises a liquid level indicator to indicate the remaining level of liquid inside the container. Preferably the liquid level indicator is located outside the container, more preferably at the top area of the container.

Figure 2:
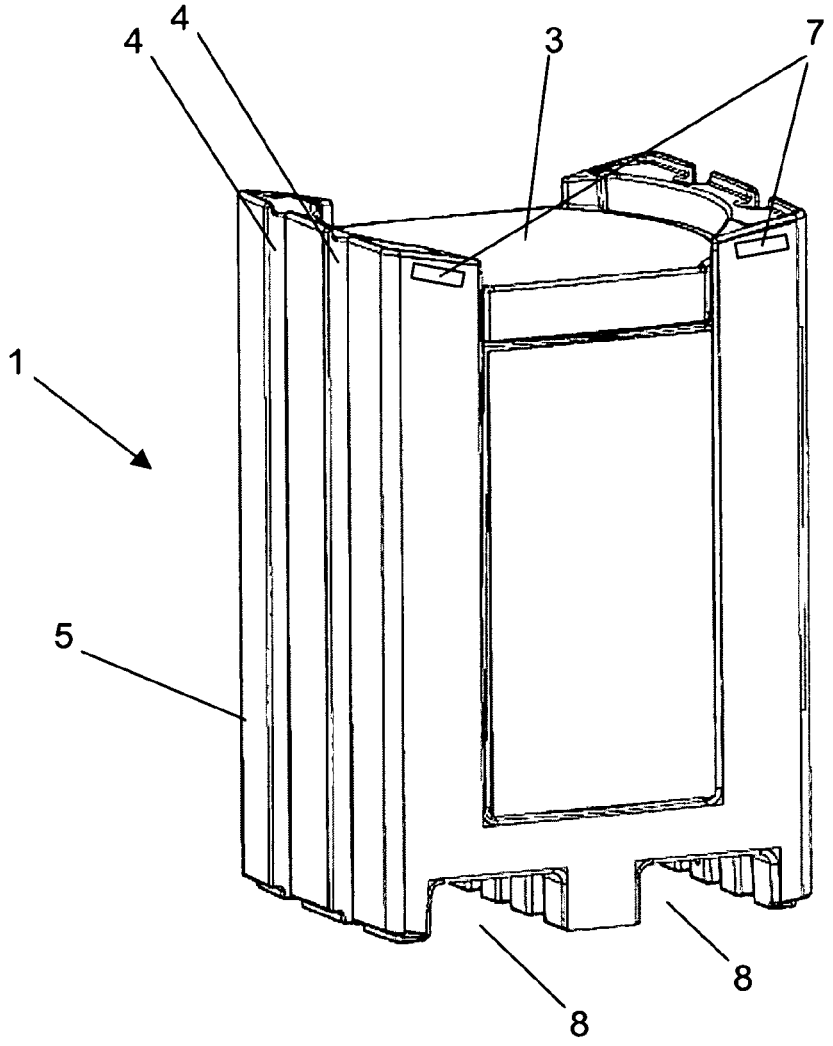
Figure 3:
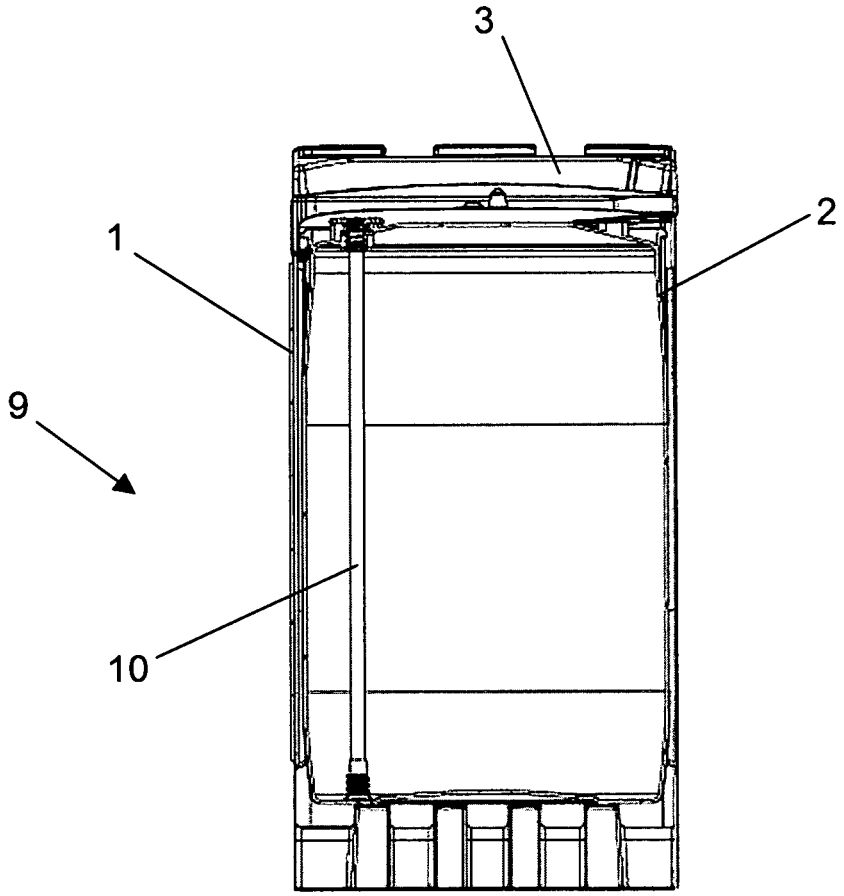

With reference to the accompanying drawings an embodiment of the present invention will now be described by way of example, in which FIG. 1 is a perspective view of an overpack according to the invention, FIG. 2 another perspective view of the overpack according to FIG. 1, and FIG. 3 is a sectional view of a safety system according to the invention.

Figure 4:
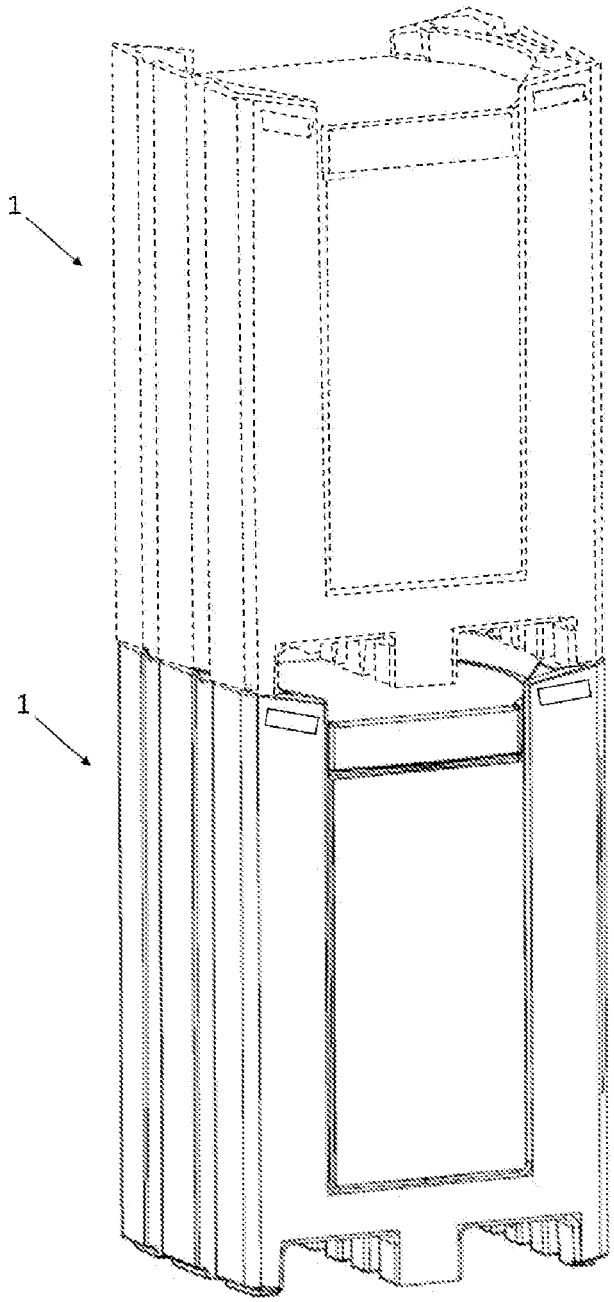

FIG. 4 is a perspective view of stacking overpacks according to the invention.

FIG. 1 shows a perspective view of an overpack 1 for storage and handling of containers for liquids, preferably for drums 2 with volumes of 200 to 500 liters. The overpack 1 is integrally formed of plastics and is stackable. The overpack 1 comprises an opening to insert the drum 2 into the overpack 1 or to remove the drum 2 from the overpack 1. The opening is covered by a lid 3, which is removably attached to the overpack 1. In an open position the lid is arrangeable next to a side wall of the overpack 1, which is the back wall of the overpack shown in FIG. 1.

To easily insert the drum 2 into or remove the drum 2 from the overpack 1 by a container handling system, like a drum lift, the opening 12 comprises recesses 15. The opening 12 further comprises a rain drain 14, to prevent fluids from entering the overpack 1 in case the opening is closed by the lid 3.

The overpack 1 of FIG. 1 has two reinforcement ribs 4 on side walls 5, 6. The reinforcement ribs 4 are located vertically at side walls 5, 6 of the overpack 1 to improve the vertical rigidity. Hence, more overpacks 1 can be stacked on top of each other without the risk of damaging the lower overpack 1. No additional reinforcements made of a second material are required.

As can be seen from FIG. 1 the overpack 1 does not comprise any undercuts, which simplifies the production process. The overpack 1 from FIG. 1 is manufactured in a rotation molding process. In a rotation molding process the mold must include additional means, like e.g. pistons, to create undercuts. Hence, the mold design and construction would be more complicated in case the overpack 1 would comprise undercuts.

The overpack 1 according to FIG. 1 comprises two cleaning openings 7 in the front wall 5. After cleaning the overpack 1 with water and/or a cleaning fluid the water and/or cleaning fluid remains inside the overpack 1, due to its spill containment function. By turning over the overpack 1 some water and/or cleaning fluid can remain inside the overpack 1, as the opening is not the lowest point of the overpack 1 in the turned over position. Through the cleaning openings 7 the remaining water/cleaning fluid can flow out of the overpack. The cleaning opening 7 is located in the upper portion of the overpack 1, hence it is in the lower part after turning over the overpack 1, and the remaining water/cleaning fluid can flow out of the overpack 1.

The base area of the overpack 1 according to FIG. 1 is about 600 mm by 800 mm. Two such overpacks 1 can be stored on a pallet according to the regulations of the European Pallet Association. This improves the transportation and storage of multiple overpacks 1.

To improve the handling of the overpack 1 from FIG. 1 the overpack 1 comprises handling recesses 8 for a fork lift. The handling recesses are located at the base portion 16 of the overpack 1, such that also a hand lift can be used to handle the overpack 1 of FIG. 1. The handling recesses 8 extend from one side wall of the overpack 1 to the opposing side wall of the overpack 1. Preferably the handling recesses 8 are accessible from the side walls with the longest dimension.

FIG. 2 shows another perspective view of the overpack 1 according to FIG. 1.

In FIG. 3 a sectional view of a safety system 9 according to the invention is shown. The safety system 9 comprises an overpack 1 according to FIG. 1 and a drum 2 inside the overpack 1. The drum 2 comprises a suction lance 10 for emptying the drum 2. The suction lance is located between the bottom and top portion of the drum 2. At the lower part the suction lance 10 has a fluid connection to the inner part of the drum 2. The upper part of the suction lance 10 is connected to the top of the drum 2 and provides a fluid connection to the outside of the drum 2. Outside the drum 2 the suction lance 10 has a dry break system 11 to connect the suction lance 10 with a consumer of the liquid contained inside the drum 2. The size of the dry break system 11 preferably changes with respect to the liquid contained inside the drum 2.

The safety system 9 according to FIG. 3 further comprises a liquid level indicator 13. The liquid level indicator 13 is located outside the drum 2, preferably in the top area of the drum 2. The liquid level indicator 13 is used to check the level of the remaining liquid inside the drum 2.

REFERENCE SYMBOLS

1 overpack
2 drum
3 lid
4 reinforcement rip
5 side wall
6 side wall
7 cleaning opening
8 handling recesses
9 safety system
10 suction lance
11 dry break system
12 opening
13 liquid level indicator
14 rain drain
15 recess
16 base portion

The invention claimed is:

1. An overpack for storage and handling of containers for liquids, the overpack comprising:

a floor and a plurality of sides extending from the floor, wherein the floor and the sides define a top portion and a bottom portion, the top portion comprising one or more openings, wherein at least one of the openings is a drain capable of draining fluid from the overpack, and the bottom portion defining a continuous surface having no openings, wherein the bottom portion is constructed to provide spill containment;

an access opening defined by the sides and opposite of the floor, wherein the access opening is configured to allow for insertion and removal of a container; and a lid removably secured to cover the access opening;

wherein the floor and the sides are integrally formed of plastic, the overpack is stackable, and wherein the overpack is adapted to receive a drum-shaped container having a volume of 200-500 liters.

2. The overpack of claim 1, the overpack further comprising walls, wherein the lid is arrangeable next to a wall of the overpack in an open position.

3. The overpack of claim 1, wherein the opening comprises recesses for access to inside of the overpack by a drum lift.

4. The overpack of claim 1, wherein the access opening comprises a rain drain to prevent fluids from entering the overpack when the access opening is closed by the lid.

5. The overpack of claim 1, wherein at least one wall of the overpack comprises at least one reinforcement rib.

6. The overpack of claim 5, wherein the at least one reinforcement rib is located vertically at the wall of the overpack.

7. The overpack of claim 1, wherein the overpack is made of a first material comprising plastic, and wherein the overpack is free of reinforcements made of a second material.

8. The overpack of claim 1, wherein the overpack is formed without undercuts.

9. The overpack of claim 1, wherein the drain comprises a cleaning opening for emptying a cleaning fluid from the overpack.

10. The overpack of claim 1, wherein the overpack has a base area of about 600 mm by 800 mm.

11. The overpack of claim 1, wherein the overpack comprises handling recesses.

12. The overpack of claim 11, wherein the handling recesses extend from one wall of the overpack an opposing wall of the overpack.

13. The overpack of claim 11, wherein the overpack comprises a base portion and wherein the handling recesses are located at the base portion of the overpack.

14. The overpack of claim 1, wherein the overpack does not comprise wheels for transportation.

15. A safety system for storage and handling of liquids comprising an overpack according to claim 1 and a container removably located inside the overpack.

16. The safety system of claim 15, wherein the container comprises a dry break system.

17. The safety system of claim 16, wherein the dry break system is configured differently for different products inside the container.

18. The safety system of claim 15, further comprising a liquid level indicator.

19. The safety system of claim 18, wherein the liquid level indicator is located outside the container in a top area of the container.

* * * * *